US010236605B1

(12) United States Patent
Henry et al.

(10) Patent No.: US 10,236,605 B1
(45) Date of Patent: Mar. 19, 2019

(54) ELECTRICAL CONNECTOR SYSTEM WITH MATING GUIDANCE FEATURES

(71) Applicant: TE CONNECTIVITY CORPORATION, Berwyn, PA (US)

(72) Inventors: Randall Robert Henry, Lebanon, PA (US); Michael John Phillips, Camp Hill, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/726,619

(22) Filed: Oct. 6, 2017

(51) Int. Cl.

| | |
|---|---|
| ***H01R 24/00*** | (2011.01) |
| ***H01R 12/70*** | (2011.01) |
| ***H01R 13/627*** | (2006.01) |
| ***H01R 12/73*** | (2011.01) |
| ***H01R 12/72*** | (2011.01) |

(52) U.S. Cl.
CPC ..... *H01R 12/7005* (2013.01); *H01R 12/721* (2013.01); *H01R 12/732* (2013.01); *H01R 13/6273* (2013.01)

(58) Field of Classification Search
CPC ..... H01R 12/73; H01R 12/737
USPC ..... 439/637, 680, 681, 374
See application file for complete search history.

(56) References Cited

U.S. PATENT DOCUMENTS

| | | | | |
|---|---|---|---|---|
| 3,740,698 | A * | 6/1973 | Jerominek | H01R 12/78 439/61 |
| 5,108,294 | A * | 4/1992 | Marsh | H01R 13/6473 439/607.01 |
| 5,879,173 | A * | 3/1999 | Poplawski | G02B 6/4246 439/138 |
| 9,166,320 | B1 | 10/2015 | Herring et al. | |
| 9,385,466 | B2 * | 7/2016 | Henry | H01R 13/506 |
| 9,397,442 | B2 * | 7/2016 | Sutter | H01R 24/62 |
| 9,728,871 | B1 | 8/2017 | Gutgold et al. | |
| 2018/0254571 | A1 | 9/2018 | Herring et al. | |

OTHER PUBLICATIONS

Pending U.S. Appl. No. 15/646,644, filed Jul. 11, 2017.
Pending U.S. Appl. No. 15/726,473, filed Oct. 6, 2017.

* cited by examiner

*Primary Examiner* — Phuong Dinh

(57) ABSTRACT

A connector system includes a first connector and a second connector. The first connector includes a plug housing that holds a circuit card. The plug housing includes a tongue portion extending to a mating end of the plug housing. The circuit card protrudes beyond the mating end. The plug housing includes a rail disposed along an outer surface of the tongue portion. The second connector includes a receptacle housing that defines a card slot configured to receive the circuit card of the first connector therein. The second connector includes a shell mounted to the receptacle housing. The shell protrudes beyond a mating end of the receptacle housing to define a receptacle that receives the tongue portion of the plug housing therein. The shell defines a guide channel configured to receive the rail of the plug housing therein as the tongue portion enters the receptacle.

20 Claims, 4 Drawing Sheets

ELECTRICAL CONNECTOR SYSTEM WITH MATING GUIDANCE FEATURES

BACKGROUND OF THE INVENTION

The subject matter herein relates generally to electrical connectors with complementary guidance features that reduce misalignment as the electrical connectors mate to each other.

Electrical connector systems typically include a receptacle connector and a plug connector. The receptacle connector defines a cavity or slot that receives a portion of the plug connector when the connectors are mated to each other. The portion of the plug connector that is received into the cavity of the receptacle connector may be relatively rigid in order to hold electrical elements, such as contact pads or contact beams, in fixed positions. For example, the portion of the plug connector may include a rigid substrate of a circuit card (e.g., board), a plastic housing or tray, or the like.

The relatively rigid portion of the plug connector can damage the receptacle connector if the plug connector is misaligned with the receptacle connector during the mating operation. For example, the receptacle connector may have spring beam contacts that extend into the cavity to engage the electrical elements of the plug connector. If a rigid portion of the plug connector enters the cavity of the receptacle at an angle offset from a desired mating orientation of the plug connector, an edge or corner of that rigid portion may dig into the spring beam contacts as the operator adjusts the orientation of the plug connector to straighten the plug connector relative to the receptacle connector. The edge or corner of the rigid portion may push one or more spring beam contacts out of position, resulting in a disrupted electrical connection and/or potentially an electrical short if two adjacent spring beams make contact. The edge or corner of the rigid portion may also break some of the spring beam contacts as the operator straightens out the misaligned plug connector within the cavity of the receptacle connector. Damage from misalignment between the connectors during mating typically occurs, but non-exclusively, in blind-mating and hard-to-reach situations in which vision of the receptacle connector and/or access to the receptacle connector is restricted as the operator attempts to couple the connectors.

Accordingly, there is a need for an electrical connector system that reduces or eliminates the risk of component damage and/or disrupted signal transmission during mating that is caused by misalignment of the connectors.

SUMMARY OF THE INVENTION

In one embodiment, a connector system is provided that includes a first connector and a second connector. The first connector includes a plug housing that holds a circuit card. The plug housing includes a base portion and a tongue portion. The tongue portion extends from the base portion to a mating end of the plug housing. The circuit card protrudes beyond the mating end of the plug housing. The plug housing includes a rail disposed along an outer surface of the tongue portion. The second connector includes a receptacle housing that defines a card slot at a mating end of the receptacle housing. The card slot is configured to receive the circuit card of the first connector therein. The second connector includes a plurality of electrical contacts held within the card slot to engage the circuit card. The second connector includes a shell mounted to the receptacle housing. The shell protrudes beyond the mating end of the receptacle housing to define a receptacle that receives the tongue portion of the plug housing therein. The shell defines a guide channel configured to receive the rail of the plug housing therein as the tongue portion enters the receptacle.

In another embodiment, an electrical connector of an electrical connector system is provided that includes a plug housing and a circuit card. The plug housing includes a base portion and a tongue portion. The tongue portion extends from the base portion to a mating end of the plug housing. The plug housing includes multiple rails disposed along an outer surface of the tongue portion. The rails extend parallel to each other and are spaced apart along a lateral width of the tongue portion between first and second outboard sides of the tongue portion. The circuit card is held by the plug housing and extends through the tongue portion. A mating segment of the circuit card protrudes beyond the mating end of the plug housing.

In another embodiment, an electrical connector of an electrical connector system is provided that includes a receptacle housing and a shell. The receptacle housing has a mating end and defines a card slot at the mating end. The receptacle housing holds a plurality of electrical contacts within the card slot. The shell is mounted to the receptacle housing. The shell protrudes beyond the mating end of the receptacle housing to define a receptacle that is fluidly connected to the card slot. The shell includes a first elongate wall and first and second side walls extending from the first elongate wall. The shell defines multiple guide channels along the first elongate wall. The guide channels extend outward from the receptacle and are fluidly connected to the receptacle. The guide channels have parallel orientations. The guide channels are spaced apart along a lateral width of the shell between the first and second side walls.

DETAILED DESCRIPTION OF THE INVENTION

Certain embodiments of the present disclosure provide an electrical connector system with complementary guidance features on the mating connectors that reducing the amount of angular misalignment permitted between the connectors as the connectors are moved towards each other, relative to connectors that lack the guidance features. By reducing the permitted amount of angular misalignment, there is a reduced risk of damage to the electrical contacts within the connectors and a reduced risk of electrical shorts and other disrupted electrical connections caused by bent or dislocated contacts.

Figure 1:
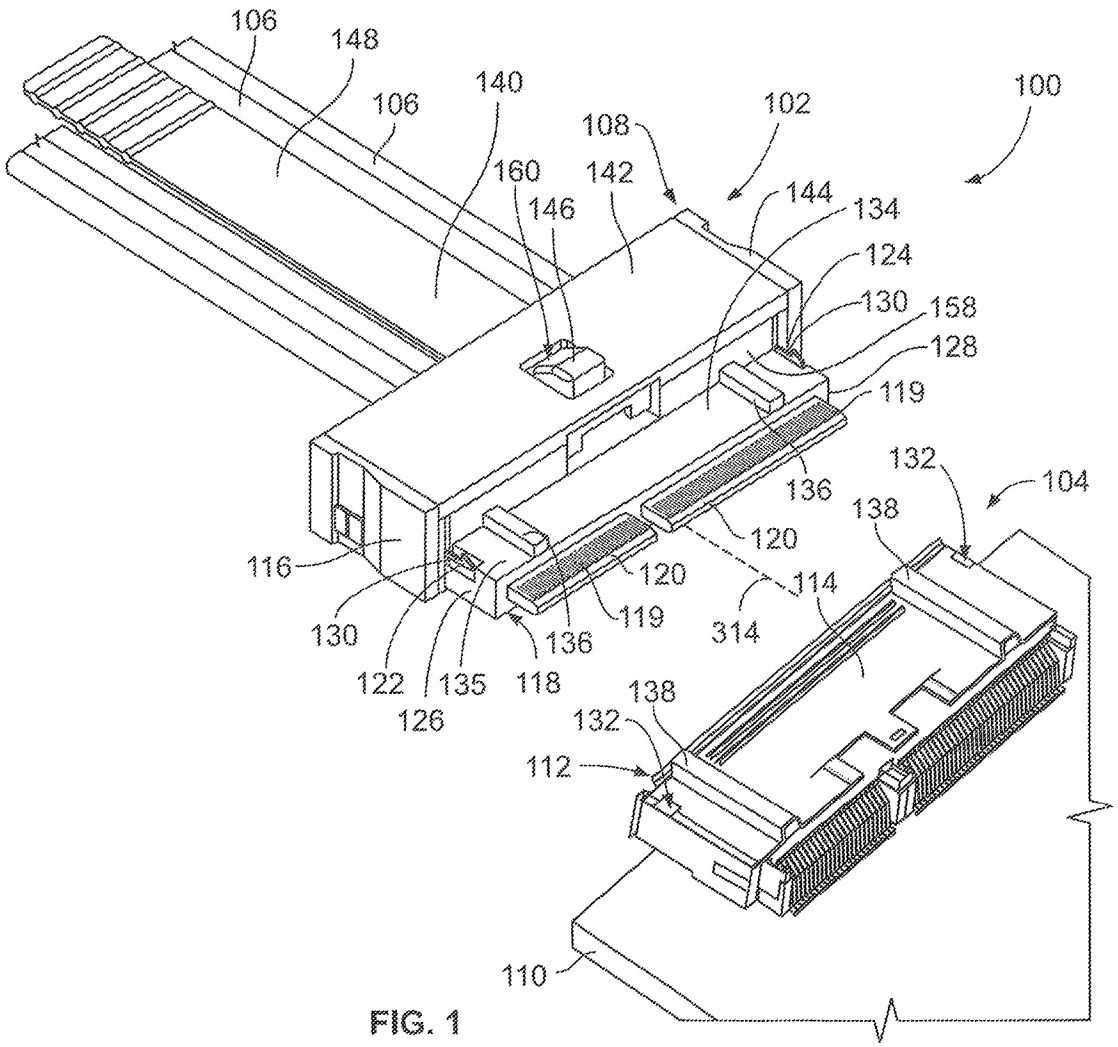
FIG. 1 is a perspective view of a connector system according to an embodiment showing a first electrical connector poised for mating to a second electrical connector.

FIG. 1 is a perspective view of a connector system 100 according to an embodiment showing a first electrical connector 102 poised for mating to a second electrical connector 104. The first electrical connector 102 is a cable-mounted connector that includes multiple electrical wires or cables 106 (e.g., collectively referred to as a cable harness) extending from a cable end 108 of the first electrical connector 102. The second electrical connector 104 in the illustrated embodiment is a right-angle board-mountable connector that is mounted to a printed circuit board 110. The second electrical connector 104 includes a shell 114 that defines a receptacle 112 configured to receive a portion of the first electrical connector 102 therein as the first and second electrical connectors 102, 104 are mated. Since a portion of the first electrical connector 102 plugs into the receptacle 112 of the second electrical connector 104, the first electrical connector 102 is referred to herein as a "plug connector," and the second electrical connector 104 is referred to as a "receptacle connector." In an alternative embodiment, the receptacle connector 104 is an inline or 180-degree connector instead of a right-angle connector. In one or more alternative embodiments, both of the connectors 102, 104 may be cable-mounted or both connectors 102, 104 may be board-mounted.

The electrical connectors 102, 104 are used to connect the electrical wires 106 (and an electrical device connected to opposite ends (not shown) of the wires 106) to circuits on the printed circuit board 110. For example, the wires 106 may extend to a different circuit board or to a different location of the same circuit board 110. The electrical connectors 102, 104 may be high speed connectors that are configured to transmit signals at frequencies up to or exceeding 10 Gbps. One or both of the connectors 102, 104 may be housed within an electronic device, such as a server, a computer, a display device, or the like. For example, the receptacle connector 104 may be disposed within the electronic device and mounted to a panel of the device, and the plug connector 102 may be outside of the electronic device, mating to the receptacle connector 104 through an opening in the panel. An operator may hold and manipulate the plug connector 102 relative to the receptacle connector 104 during the mating process. Due to the location of the receptacle connector 104, it may be difficult for the operator to see and/or access the receptacle connector 104, resulting in a blind-mating between the connectors 102, 104. It may be difficult for the operator to properly align and orient the plug connector 102 relative to the receptacle connector 104 during mating. The electrical connectors 102, 104 include guidance features to reduce the risk of damage caused by misalignment of the connectors 102, 104 during mating.

The plug connector 102 includes a plug housing 116 that holds and supports a plurality of electrical conductors used to convey electrical signals. The plug connector 102 includes one or more circuit cards 120 held by the plug housing 116. The one or more circuit cards 120 include contact pads 119 and electrical traces (not shown) that represent the electrical conductors of the plug connector 102. The plug housing 116 has a mating end 118. In the illustrated embodiment, the mating end 118 is opposite to the cable end 108, but the mating end 118 may have a different location and/or orientation relative to the cable end 108 in a different embodiment. The one or more circuit cards 120 protrude from the mating end 118 of the plug housing 116. The contact pads 119 of the circuit card(s) 120 are arrange side-by-side across a lateral width of the circuit card(s) 120 along an exposed segment that is beyond the mating end 118 of the plug housing 116. Although not visible in FIG. 1, the wires 106 are electrically terminated to the circuit card(s) 120 within the plug housing 116. In an alternative embodiment, the electrical conductors of the plug connector 102 may include deflectable contact beams or the like instead of conductive traces and contact pads 119 on a circuit card 120.

The plug housing 116 may include base portion 158 and a tongue portion 134. The tongue portion 134 extends from the base portion 158 to the mating end 118. The base portion 158 is larger than the tongue portion 134. The wires 106 terminate to the circuit card(s) 120 within the base portion 158. The circuit card(s) 120 extend through and protrude from the tongue portion 134 at the mating end 118. The base portion 158 may define the cable end 108.

The plug connector 102 further includes first and second latch arms 122, 124 that are used to removably latch the plug connector 102 to the receptacle connector 104 when mated. In the illustrated embodiment, the latch arms 122, 124 extend from the base portion 158. The first latch arm 122 is disposed at (or proximate to) a first outboard side 126 of the tongue portion 134. The second latch arm 124 is disposed at (or proximate to) a second outboard side 128 of the tongue portion 134 that is opposite to the first outboard side 126. Thus, the latch arms 122, 124 are spaced apart laterally from each other a distance that is approximately the entire width of the tongue portion 134. Each of the latch arms 122, 124 includes a respective hook tip 130 configured to be received within a corresponding opening 132 of the shell 114 of the receptacle connector 104 when the connectors 102, 104 are mated to latch or couple the connectors 102, 104 together. The wide latching stance increases the ability of the plug connector 102 to withstand twisting forces without pivoting or twisting within the receptacle 112 compared to known connectors that have narrower latching mechanisms. The wide latching stance may also increase the axial pull load that can be withstood by the plug connector 102 without uncoupling from the receptacle connector 104 relative to the latching mechanisms of the known connectors.

The plug connector 102 further includes a tether 140 and a cover plate 142. The cover plate 142 is mounted to a top side 144 of the plug housing 116. As used herein, relative or spatial terms such as "top," "bottom," "front," "rear," "upper," and "lower" are only used to distinguish the referenced elements and do not necessarily require particular positions or orientations relative to gravity or to the surrounding environment of the connector system 100. The tether 140 is held vertically between the cover plate 142 and the housing 116. The tether 140 includes a push button 146 that protrudes at least partially through a window 160 in the cover plate 142. A free segment 148 of the tether 140 extends from the cable end 108 of the plug connector 102. The tether 140 is operatively connected to the latch arms 122, 124 within the base portion 158 of the housing 116. The tether 140 is configured to be manually actuated by a user to selectively pivot the latch arms 122, 124 in order to unlatch the plug connector 102 from the receptacle connector 104. For example, the push button 146 may be depressed (downward towards the circuit card 120) and/or the free segment 148 may be pulled rearward (in a direction away from the receptacle connector 104) in order to pivot the latch arms 122, 124.

The plug connector 102 includes one or more guidance features configured to engage the shell 114 of the receptacle connector 104 to support proper alignment of the plug connector 102 relative to the shell 114 as the plug connector 102 is loaded into the receptacle 112 of the shell 114 during mating. In one or more embodiments, the plug housing 116 includes one or more rails 136 on the tongue portion 134 that represent guidance features. The plug housing 116 includes two rails 136 in the illustrated embodiment, but may have a different number of rails 136, such as only one or more than two, in other embodiments. The rails 136 are disposed on an outer surface 135 of the tongue portion 134.

The receptacle connector 104 includes one or more guidance features that are complementary to the guidance features on the plug connector 102. In one or more embodiments, the shell 114 of the receptacle connector 104 includes one or more guide channels 138 that represent guidance features. Each of the guide channels 138 is configured to receive a corresponding one of the rails 136 of the plug housing 116 therein as the plug connector 102 is loaded into the receptacle 112 of the shell 114. The number of guide channels 138 may correspond to the number of rails 136 on the plug connector 102. The shell 114 includes two guide channels 138 in the illustrated embodiment, but may have a different number of guide channels 138 in other embodiments.

Figure 2:
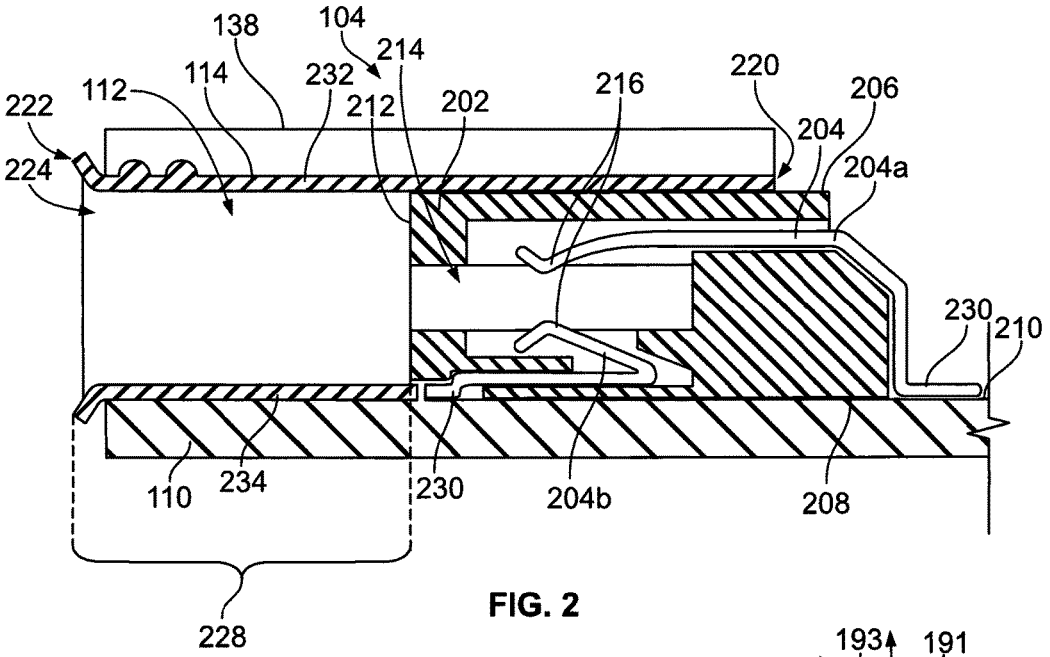
FIG. 2 illustrates a cross-sectional side view of the second electrical connector mounted on a printed circuit board according to an embodiment.

FIG. 2 illustrates a cross-sectional side view of the receptacle connector 104 mounted on the printed circuit board 110 according to an embodiment. The receptacle connector 104 includes a receptacle housing 202 that holds a plurality of electrical conductors 204. The receptacle housing 202 in the illustrated embodiment has a top side 206 and a bottom side 208 that is opposite to the top side 206. The bottom side 208 faces a top surface 210 of the circuit board 110, and optionally engages the top surface 210. The receptacle housing 202 includes a mating end 212. In the illustrated embodiment, the mating end 212 extends between the top and bottom sides 206, 208, and is oriented perpendicular to the top surface 210 of the circuit board 110. The receptacle housing 202 defines a card slot 214 that is open at the mating end 212. The card slot 214 is configured to receive the circuit card 120 (shown in FIG. 1) of the plug connector 102 (FIG. 1) therein during mating.

The electrical conductors 204 of the receptacle connector 104 include electrical contacts 216 that extend at least partially into the card slot 214. The electrical contacts 216 may represent mating end segments of the electrical conductors 204. The electrical contacts 216 are configured to engage and electrically connect to the contact pads 119 (FIG. 1) on the circuit card 120. In an embodiment, the electrical contacts 216 are deflectable spring beams configured to be deflected outward towards the top side 206 or the bottom side 208 of the receptacle housing 202 by the circuit card 120. For example, the electrical conductors 204 include upper conductors 204A and lower conductors 204B. The contacts 216 of the upper conductors 204A are deflected towards the top side 206 by the circuit card 120, and the contacts 216 of the lower conductors 204B are deflected towards the bottom side 208 by the circuit card 120 as the circuit card 120 is received into the card slot 214. Although FIG. 2 only shows one upper conductor 204A and one lower conductor 204B, the receptacle connector 104 in an embodiment includes a plurality of upper conductors 204A and a plurality of lower conductors 204B. In the illustrated embodiment, the electrical conductors 204 have solder tails 230 that are surface-mounted to the top surface 210 of the circuit board 110. In an alternative embodiment, the electrical conductors 204 may have pins that are through-hole mounted to the circuit board 110 instead of solder tails 230.

The shell 114 of the receptacle connector 104 includes a mounting end 220 and a distal end 222 that is opposite to the mounting end 220. The mounting end 220 engages and at least partially surrounds the receptacle housing 202. The shell 114 protrudes beyond the mating end 212 of the receptacle housing 202 to define the receptacle 112. For example, the distal end 222 of the shell 114 is spaced apart from the mating end 212 of the receptacle housing 202, such that the shell 114 has a free-standing portion 228 that does not engage the receptacle housing 202. The receptacle 112 of the shell 114 is defined along the free-standing portion 228 adjacent to the mating end 212 of the housing 202. The receptacle 112 is fluidly connected to the card slot 214. The distal end 222 of the shell 114 defines an entrance 224 to the receptacle 112. The mating end 212 of the receptacle housing 202 represents a back end of the receptacle 112 that is opposite the entrance 224.

The shell 114 includes multiple walls that define the receptacle 112. For example, the shell 114 includes a first elongate wall 232 and a second elongate wall 234. Due to the illustrated orientation, the first elongate wall 232 is referred to herein as a "top elongate wall," and the second elongate wall 234 is referred to herein as a "bottom elongate wall." The top and bottom elongate walls 232, 234 extend between the mounting end 220 and the distal end 222 of the shell 114. The top elongate wall 232 is disposed on the top side 206 of the receptacle housing 202. The bottom elongate wall 234 is disposed between the bottom side 208 of the receptacle housing 202 and the top surface 210 of the circuit board 110. In the illustrated orientation of the receptacle connector 104, one guide channel 138 is visible along the top elongate wall 232, but the line of cross-section does not extend through the guide channel 138.

The receptacle 112 of the shell 114 is configured to receive the tongue portion 134 (shown in FIG. 1) of the plug housing 116 (FIG. 1) therein during the mating operation. For example, both the circuit card 120 and the tongue portion 134 may enter the receptacle 112, but, in an embodiment, only the circuit card 120 enters the card slot 214. The receptacle 112 has a larger height between the top and bottom elongate walls 232, 234 than a height of the card slot 214. The tongue portion 134 may fit within the receptacle 112, but may be too tall or thick to fit within the card slot 214. Optionally, the mating end 118 (FIG. 1) of the tongue portion 134 may abut against the mating end 212 of the receptacle housing 202 when the plug connector 102 (FIG. 1) is fully mated to the receptacle connector 104 to prevent additional movement of the plug connector 102 in a loading direction relative to the receptacle connector 104.

Figure 3:
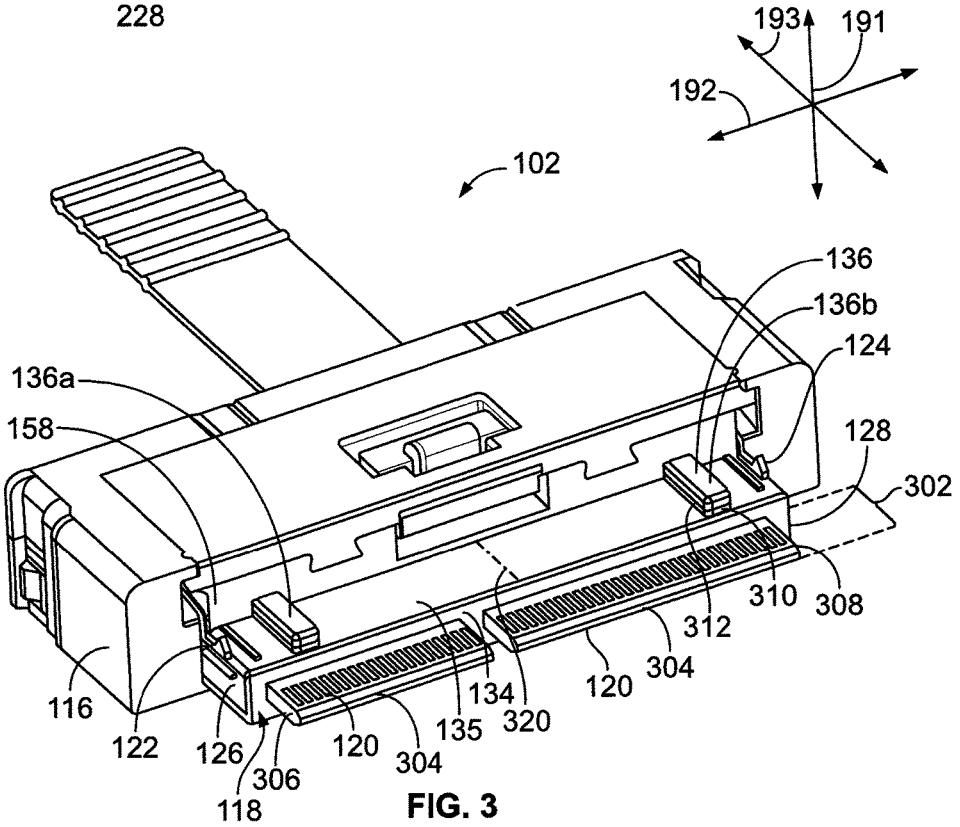
FIG. 3 is a perspective view of the first electrical connector according to an embodiment.

FIG. 3 is a perspective view of the plug connector 102 according to an embodiment. The plug connector 102 is oriented with respect to a vertical or elevation axis 191, a lateral axis 192, and a longitudinal axis 193. The axes 191-193 are mutually perpendicular. Although the vertical axis 191 appears to extend generally parallel to gravity, it is understood that the axes 191-193 are not required to have any particular orientation with respect to gravity.

The one or more circuit cards 120 include mating segments 302 that protrude from the mating end 118 of the plug housing 116 (e.g., at the tongue portion 134) to respective front edges 304 of the circuit cards 120. The mating segment 302 is the portion of the circuit card 120 that is received in the card slot 214 (shown in FIG. 2) of the receptacle connector 104 (FIG. 2) during mating. The front edges 304 extend laterally (e.g., parallel to the lateral axis 192) between a first side edge 306 and a second side edge 308 of the circuit cards 120.

In the illustrated embodiment, the plug connector 102 includes two rails 136 that are laterally spaced apart from each other along the outer surface 135 of the tongue portion 134 between the first and second outboard sides 126, 128 of the tongue portion 134. The rails 136 may have identical, or at least similar, sizes, shapes, and constructions, so the following description of a single rail 136 may apply to both rails 136. The rail 136 extends linearly along (e.g., parallel to) the longitudinal axis 193. The rail 136 is elongated perpendicularly to the front edges 304 of the circuit cards 120. The orientation of the rail 136 is parallel to a desired loading axis 314 (shown in FIG. 1) that represents the proper angular alignment of the plug connector 102 to the receptacle connector 104 (FIG. 1).

The rail 136 extends from the base portion 158 to a respective front end 310 of the rail 136 that is at, or proximate to, the mating end 118 of the plug housing 116. The rail 136 projects outward (e.g., vertically upward) from the outer surface 135 of the tongue portion 134. The rail 136 may be integral to the tongue portion 134 such that an interface 312 between the rail 136 and the outer surface 135 is seamless. For example, the rail 136 may be formed during a common molding process with the tongue portion 134, or, alternatively, may be welded or otherwise permanently affixed to the tongue portion 134 to define a seamless interface 312.

In the illustrated embodiment, the two rails 136 are disposed between the first and second latch arms 122, 124 of the plug connector 102. A first rail 136A of the two rails 136 is located proximate to the first outboard side 126 of the tongue portion 134. A second rail 136B of the two rails 136 is located proximate to the second outboard side 128 of the tongue portion 134. For example, the first rail 136A is located more proximate to the first outboard side 126 than to a lateral center 320 of the tongue portion 134 that is halfway between the first and second outboard sides 126, 128. Similarly, the second rail 136B is located more proximate to the second outboard side 128 than to the lateral center 320 of the tongue portion 134. The relatively wide stance of the two rails 136A, 136B is configured to prevent (or at least reduce the extent of) the mating segments 302 of the circuit cards 120 entering the card slot 214 (shown in FIG. 2) when the plug connector 102 is misaligned with the receptacle connector 104 (FIG. 2), reducing or eliminating the risk of damage to the electrical contacts 216 (FIG. 2) of the receptacle connector 104 when straightening out the misaligned plug connector 102.

Figure 4:
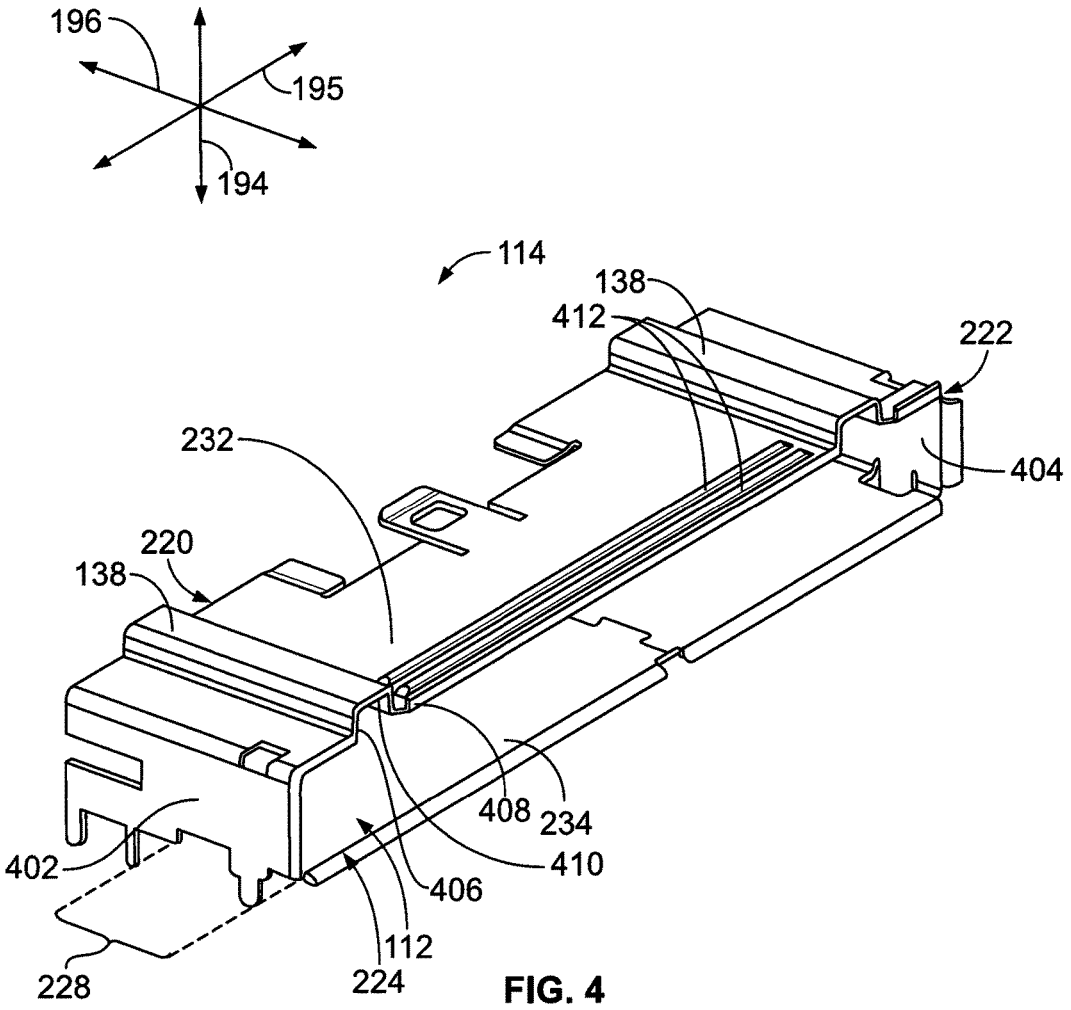
FIG. 4 is a perspective view of a shell of the second electrical connector according to an embodiment.

FIG. 4 is a perspective view of the shell 114 of the receptacle connector 104 according to an embodiment. The shell 114 is oriented with respect to a vertical or elevation axis 194, a lateral axis 195, and a longitudinal axis 196. The axes 194-196 are mutually perpendicular. Although the vertical axis 194 appears to extend generally parallel to gravity, it is understood that the axes 194-196 are not required to have any particular orientation with respect to gravity.

The shell 114 includes the top and bottom elongate walls 232, 234 and first and second side walls 402, 404. Each of the first and second side walls 402, 404 extend between and electrically connect to the top and bottom elongate walls 232, 234. The receptacle 112 is defined laterally between the first and second side walls 402, 404, and is defined vertically between the top and bottom elongate walls 232, 234. The shell 114 has a generally rectangular cross-sectional shape defined by the elongate walls 232, 234 and the side walls 402, 404. The elongate walls 232, 234 represent the longer lengths of the rectangular shape, and the side walls 402, 404 represent the shorter lengths. In an embodiment, the shell 114 is metallic and is stamped and formed from a sheet of metal. Alternatively, the shell 114 may be an assembly of multiple sheets of metal, or may be formed via molding or extruding instead of stamping and forming.

The receptacle 112 of the shell 114 has a size and shape that is complementary to the size and shape of the tongue portion 134 (shown in FIG. 3) of the plug connector 102 (FIG. 3). For example, the outer surface 135 (FIG. 3) of the tongue portion 134 may engage and slide along the top elongate wall 232 of the shell 114 during mating. When the plug connector 102 is misaligned relative to the shell 114, then the front end 310 (FIG. 3) of at least one of the rails 136 (FIG. 3) abuts against the distal end 222 of the shell 114 without being received in the receptacle 112. The engagement between the front end 310 of the rail 136 and the distal end 222 of the shell 114 blocks additional movement of the misaligned plug connector 102 into the receptacle 112 until the plug connector 102 is properly aligned (e.g., straightened out).

In the illustrated embodiment, the shell 114 includes two guide channels 138 that are disposed along the top elongate wall 232. The two guide channels 138 are spaced apart laterally from each other along a width of the shell 114 between the first and second side walls 402, 404. As described above, the number of guide channels 138 and the positioning of the guide channels 138 corresponds to the number and positions of the rails 136 (FIG. 3) of the plug connector 102 (FIG. 3), as each of the guide channels 138 is configured to receive a different corresponding one of the rails 136 therein during mating.

In an embodiment, the guide channels 138 extend outward from the receptacle 112 (e.g., in a direction away from the bottom elongate wall 234). The guide channels 138 are open (e.g., fluidly connected) to the receptacle 112. The height of the receptacle 112 between the top and bottom elongate walls 232, 234 is greater at the guide channels 138 than at locations laterally spaced apart from the guide channels 138. In an embodiment, the guide channels 138 are formed by bending or pressing the top elongate wall 232 into a groove or trough-like shape extending away from the receptacle 112. Each of the guide channels 138 is defined between first and second sides 406, 408 that extend outward from the top elongate wall 232. The first and second sides 406, 408 of each guide channel 138 are connected by a ceiling 410. The guide channels 138 have sizes and shapes that correspond to the sizes and shapes of the rails 136 (FIG. 3) such that the rails 136 are able to fit within the corresponding guide channels 138 with a relatively limited amount of clearance to reduce the permissible amount of angular misalignment when mating.

The guide channels 138 may extend linearly from the distal end 222 of the shell 114 towards the mounting end 220. For example, the guide channels 138 extend parallel to each other along the longitudinal axis 196. In the illustrated embodiment, the guide channels 138 extend the full length from the distal end 222 to the mounting end 220, but the guide channels 138 may only extend part of the length of the shell 114 in an alternative embodiment.

The shell 114 optionally includes one or more stiffening ribs 412. The shell 114 has two stiffening ribs 412 in the illustrated embodiment, but may have additional or fewer ribs in other embodiments. The stiffening ribs 412 are located on the top elongate wall 232. The stiffening ribs 412 may be integral to the top elongate wall 232. For example, the ribs 412 may be formed in the metal material of the wall 232 during a common molding process, or may be welding or brazed onto the top elongate wall 232. Alternatively, the ribs 412 may be discrete components that are bonded or fastened to the top elongate wall 232. The ribs 412 extend parallel to the lateral axis 195 that extends between the first and second side walls 402, 404. In the illustrated embodiment, the ribs 412 are disposed between the two guide channels 138. For example, the guide channels 138 are located relatively close to the corresponding side walls 402, 404, and the stiffening ribs 412 extend between the guide channels 138 along the top elongate wall 232. In the illustrated embodiment, the stiffening ribs 412 are located at, or proximate to, the distal end 222 of the shell 114 along the free-standing portion 228 of the shell 114.

The stiffening ribs 412 add structural support and rigidity to that intermediary portion of the top elongate wall 232 between the guide channels 138 at the distal end 222 that defines the entrance 224 to the receptacle 112. The stiffening ribs 412 may reduce the likelihood that the top elongate wall 232 bows outward or otherwise deforms when the plug connector 102 (FIG. 3) is attempted to be loaded into the receptacle 112 at a misaligned angle relative to the shell 114. For example, the ribs 412 may allow the shell 114 to withstand the forces exerted by one or more of the rails 136 (FIG. 3) of an angularly-misaligned plug connector 102 on the distal end 222 of the shell 114 without deforming.

Figure 5:
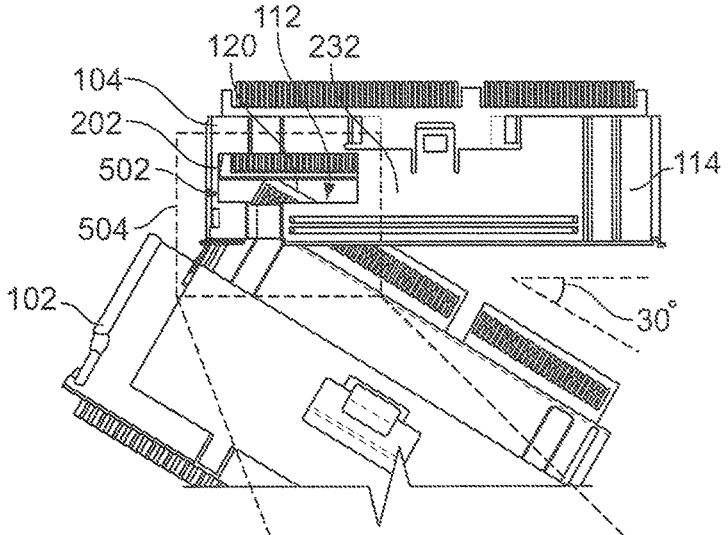
FIG. 5 is a top-down view of the plug connector and the receptacle connector according to an embodiment showing the plug connector angularly misaligned relative to the receptacle connector.

FIG. 5 is a top-down view of the plug connector 102 and the receptacle connector 104 according to an embodiment showing the plug connector 102 angularly misaligned relative to the receptacle connector 104. For example, the plug connector 102 is approximately 30 degrees angularly offset from a proper orientation angle relative to the receptacle connector 104. The illustration in FIG. 5 includes a peephole 502 through the top elongate wall 232 of the shell 114 in order to view the circuit card 120 of the plug connector 102 relative to the receptacle housing 202 within the receptacle 112 of the shell 114.

Figure 6:
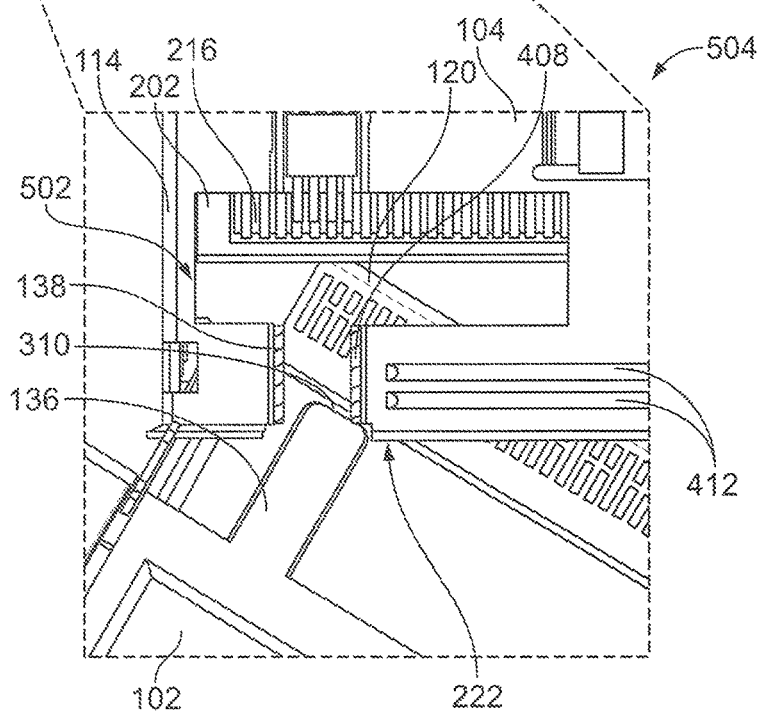
FIG. 6 is an enlarged view of a portion of the receptacle connector and the plug connector in the misaligned orientation shown in FIG. 5.

FIG. 6 is an enlarged view of a portion 504 of the receptacle connector 104 and the plug connector 102 in the misaligned orientation shown in FIG. 5. FIG. 6 shows the peephole 502 through the shell 114 as shown in FIG. 5. In FIG. 6, the illustrated guide channel 138 of the receptacle connector 104 is shown in cross-section such that the ceiling member 410 (shown in FIG. 4) is omitted. In the illustrated embodiment, since the plug connector 102 is misaligned relative to the receptacle connector 104, the guidance features prohibit the circuit card 120 of the plug connector 102 from being received within the card slot 214 (shown in FIG. 2) of the receptacle housing 202 far enough to engage the electrical contacts 216. Due to the misalignment, the rail 136 is not received cleanly into the guide channel 138. Instead, the front end 310 of the rail 136 abuts against the second side 408 of the guide channel 138 at the distal end 222 of the shell 114. The ribs 412 on the top elongate wall 232 of the shell 114 prohibit the top elongate wall 232 from bowing outward due to the force exerted by the rail 136 on the side 408.

The engagement between the front end 310 of the rail 136 and the side 408 blocks additional movement of the plug connector 102 into the receptacle 112 until the plug connector 102 is better aligned with the receptacle connector 104. In the blocked position of the plug connector 102 shown in FIG. 6, the circuit card 120 of the plug connector 102 is spaced apart from, and does not engage, the electrical contacts 216 in the receptacle housing 202. Therefore, there is no risk of damage to the electrical contacts 216 from the circuit card 120 as the plug connector 102 is subsequently straightened out relative to the receptacle connector 104. Upon pivoting the plug connector 102 towards the proper alignment angle, the rail 136 eventually enters and moves through the guide channel 138. At this point, the circuit card 120 enters the card slot 214 (FIG. 2) and engages the electrical contacts 216. In an embodiment, the guide channel 138 has sufficient clearance relative to the rail 136 to allow the rail 136 into the guide channel 138 when the plug connector 102 is within about 3 degrees of the proper alignment angle, but the permissible range of alignment for mating may be different in other embodiments.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely example embodiments. Many other embodiments and modifications within the spirit and scope of the claims will be apparent to those of ordinary skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

what is claimed is:

1. A connector system comprising:

a first connector including a plug housing holding a circuit card, the plug housing including a base portion and a tongue portion, the tongue portion extending from the base portion to a mating end of the plug housing, the circuit card protruding beyond the mating end of the plug housing, the plug housing including a rail disposed along an outer surface of the tongue portion; and a second connector including a receptacle housing that defines a card slot at a mating end of the receptacle housing, the card slot configured to receive the circuit card of the first connector therein, the second connector including a plurality of electrical contacts held within the card slot to engage the circuit card, the second connector including a shell mounted to the receptacle housing, the shell protruding beyond the mating end of the receptacle housing to define a receptacle that receives the tongue portion of the plug housing therein, the shell defining a guide channel configured to receive the rail of the plug housing therein as the tongue portion enters the receptacle.

2. The connector system of claim 1, wherein the circuit card protrudes beyond the mating end of the plug housing to a front edge of the circuit card that extends laterally between first and second side edges of the circuit card, the rail of the plug housing extending linearly along a longitudinal axis that is perpendicular to the front edge of the circuit card.

3. The connector system of claim 1, wherein the shell includes a first elongate wall, a second elongate wall, and first and second side walls extending between and connecting to the first and second elongate walls, the receptacle defined between the first and second elongate walls and between the first and second side walls, the guide channel disposed along the first elongate wall and fluidly connected to the receptacle.

4. The connector system of claim 3, wherein the shell includes one or more stiffening ribs on the first elongate wall, the one or more stiffening ribs extending parallel to a lateral axis that extends between the first and second side walls.

5. The connector system of claim 3, wherein the guide channel includes first and second sides extending outward from the first elongate wall away from the receptacle, the guide channel including a ceiling that extends between and connects to the first and second sides.

6. The connector system of claim 1, wherein the shell includes a mounting end and a distal end opposite to the mounting end, the mounting end engaging and at least partially surrounding the receptacle housing, the distal end of the shell spaced apart from the mating end of the receptacle housing and defining an entrance to the receptacle, the guide channel extending linearly from the distal end towards the mounting end along a longitudinal axis.

7. The connector system of claim 6, wherein the receptacle of the shell has a size and shape that is complementary to a size and shape of the tongue portion such that, when the first connector is misaligned relative to the receptacle, a front end of the rail along the outer surface of the tongue portion abuts against the distal end of the shell without being received into the guide channel.

8. The connector system of claim 1, wherein the rail is integral to tongue portion such that an interface between the rail and the outer surface of the tongue portion is seamless.

9. The connector system of claim 1, wherein the first connector includes first and second latch arms extending from the base portion, the first latch arm located proximate to a first outboard side of the tongue portion, the second latch arm located proximate to a second outboard side of the tongue portion that is opposite to the first outboard side, the rail disposed between the first and second latch arms, the first and second latch arms configured to latch onto the shell of the second connector.

10. The connector system of claim 1, wherein the rail is a first rail and the first connector further includes a second rail disposed along the outer surface of the tongue portion and spaced apart laterally from the first rail between first and second outboard sides of the tongue portion, wherein the guide channel of the shell is a first guide channel configured to receive the first rail therein, and the shell further includes a second guide channel configured to receive the second rail therein.

11. The connector system of claim 10, wherein the shell includes a first elongate wall, a second elongate wall, and first and second side walls extending between and connecting to the first and second elongate walls, the first and second guide channels being spaced apart laterally along the first elongate wall, the shell further including one or more stiffening ribs on the first elongate wall extending laterally between first and second guide channels.

12. The connector system of claim 10, wherein the first rail is located more proximate to the first outboard side of the tongue portion than to a lateral center of the tongue portion that is halfway between the first and second outboard sides, the second rail located more proximate to the second outboard side than to the lateral center.

13. An electrical connector of an electrical connector system, the electrical connector comprising:

a plug housing including a base portion and a tongue portion, the tongue portion extending from the base portion to a mating end of the plug housing, the plug housing including multiple rails disposed along an outer surface of the tongue portion, the rails extending parallel to each other and spaced apart along a lateral width of the tongue portion between first and second outboard sides of the tongue portion; and a circuit card held by the plug housing and extending through the tongue portion, a mating segment of the circuit card protruding beyond the mating end of the plug housing.

14. The electrical connector of claim 13, wherein the mating segment of the circuit card and the tongue portion of the plug housing are configured to be received within a receptacle of a shell of a mating connector during a mating operation, the rails of the plug housing received within corresponding guide channels of the shell as the tongue portion is received within the receptacle of the shell.

15. The electrical connector of claim 13, wherein the multiple rails include a first rail that is located more proximate to the first outboard side of the tongue portion than to a lateral center of the tongue portion that is halfway between the first and second outboard sides, the multiple rails also including a second rail that is located more proximate to the second outboard side than to the lateral center.

16. The electrical connector of claim 13, further including first and second latch arms extending from the base portion of the plug housing, the first latch arm located at the first outboard side of the tongue portion, the second latch arm located at the second outboard side of the tongue portion, the multiple rails disposed between the first and second latch arms, the first and second latch arms configured to latch onto the shell of the mating connector.

17. An electrical connector of an electrical connector system, the electrical connector comprising:

a receptacle housing having a mating end and defining a card slot at the mating end, the receptacle housing holding a plurality of electrical contacts within the card slot; and a shell mounted to the receptacle housing, the shell protruding beyond the mating end of the receptacle housing to define a receptacle that is fluidly connected to the card slot, the shell including a first elongate wall and first and second side walls extending from the first elongate wall, the shell defining multiple guide channels along the first elongate wall, the guide channels extending outward from the receptacle and fluidly connected to the receptacle, the guide channels having parallel orientations, the guide channels spaced apart along a lateral width of the shell between the first and second side walls.

18. The electrical connector of claim 17, wherein each of the guide channels is configured to receive a corresponding rail of a plug housing therein during a mating operation as the plug housing is loaded into the receptacle of the shell.

19. The electrical connector of claim 17, wherein the receptacle housing has a top side and a bottom side that is opposite the top side, the bottom side facing a top surface of a circuit board, the mating end of the receptacle housing oriented perpendicular to top surface of the circuit board, the first elongate wall of the shell disposed on the top side of the receptacle housing.

20. The electrical connector of claim 17, wherein the shell protrudes beyond the mating end of the receptacle housing to a distal end of the shell that defines an entrance to the receptacle, the guide channels extending linearly from the distal end towards the receptacle housing along a longitudinal axis, the first elongate wall including one or more stiffening ribs extending laterally between two of the guide channels, the stiffening ribs disposed proximate to the distal end of the shell along a free-standing portion of the shell that is spaced apart from the receptacle housing.

* * * * *